US009604113B2

(12) United States Patent
Fierro et al.

(10) Patent No.: US 9,604,113 B2
(45) Date of Patent: Mar. 28, 2017

(54) ATHLETIC SWING TRAINING WEIGHT AND METHOD

(71) Applicants: Joseph Reza Fierro, Westminster, CO (US); Matthew Michael Vellone, Boulder, CO (US)

(72) Inventors: Joseph Reza Fierro, Westminster, CO (US); Matthew Michael Vellone, Boulder, CO (US)

(73) Assignee: Rocky Mountain Athletics Company, LLC, Westminster, CO (US)

( * ) Notice: Subject to any disclaimer, the term of this patent is extended or adjusted under 35 U.S.C. 154(b) by 23 days.

(21) Appl. No.: 14/726,576

(22) Filed: May 31, 2015

(65) Prior Publication Data

US 2016/0346658 A1 Dec. 1, 2016

(51) Int. Cl.

*A63B 69/00* (2006.01)
*A63B 21/00* (2006.01)
*A63B 15/00* (2006.01)

(52) U.S. Cl.

CPC ..... *A63B 69/0002* (2013.01); *A63B 21/0004* (2013.01); *A63B 15/005* (2013.01); *A63B 2069/0008* (2013.01); *A63B 2208/0204* (2013.01)

(58) Field of Classification Search

CPC ..... A63B 15/005; A63B 69/0002; A63B 2069/0008
USPC ..... 473/437, 457, 519
See application file for complete search history.

(56) References Cited

U.S. PATENT DOCUMENTS 2,950,115 A * 8/1960 Hurdzan ..... A63B 15/005 473/234
3,173,688 A * 3/1965 Green ..... A63B 59/50 446/418
4,027,886 A * 6/1977 Katsube ..... A63B 69/3632 273/456
4,634,121 A * 1/1987 Sasaki ..... A63B 15/00 473/457
4,809,975 A * 3/1989 Lee ..... A63B 15/005 473/256
5,050,877 A * 9/1991 Wales ..... A63B 69/0002 473/437
5,360,209 A * 11/1994 Mollica ..... A63B 15/005 473/457
6,955,610 B1 * 10/2005 Czaja ..... A63B 15/005 473/220

(Continued)

*Primary Examiner* — Mark Graham

(57) ABSTRACT

A swing training weight and method for building the strength and control of a user, while teaching proper swing mechanics. The swing training weight is attached to athletic equipment during training or while warming up for competition, and provides an improved means of release from the athletic equipment. The swing training weight incorporates a sliding member that simulates the impact of striking an object and provides audible, visual and tactile feedback to the user pertaining to the proper execution of the swing. Training methods using the swing training weight are provided that improve athletic performance, and allow for focused training of the proper execution of specific elements of an athletic swing. Further, the swing training weight incorporates a movable stop that allows the weight to be configured to provide for training methods that further focus on the proper execution of specific swing elements.

18 Claims, 7 Drawing Sheets

(56) References Cited

U.S. PATENT DOCUMENTS

| | | | | |
|---|---|---|---|---|
| 7,297,077 | B1 * | 11/2007 | Battaglino | A63B 59/00 473/422 |
| 7,297,078 | B2 * | 11/2007 | Libonati | A63B 15/005 473/422 |
| 7,618,328 | B2 * | 11/2009 | Davenport | A63B 69/3623 473/219 |
| 7,686,711 | B2 * | 3/2010 | Miller | A63B 69/0002 473/422 |
| 8,540,584 | B1 * | 9/2013 | Sorenson | A63B 69/36 473/219 |
| 8,936,522 | B2 * | 1/2015 | Weston | A63B 15/00 473/422 |
| 9,144,726 | B2 * | 9/2015 | Whitney | A63B 69/0002 |
| 2004/0048696 | A1 * | 3/2004 | Ciesar | A63B 69/0002 473/457 |
| 2005/0009618 | A1 * | 1/2005 | Leadbetter | A63B 53/14 473/257 |
| 2010/0234144 | A1 * | 9/2010 | Sutlovich | A63B 69/0002 473/457 |
| 2010/0248867 | A1 * | 9/2010 | Tande | A63B 15/005 473/457 |
| 2011/0034275 | A1 * | 2/2011 | Kim | A63B 15/005 473/457 |
| 2016/0206942 | A1 * | 7/2016 | Smith, Jr. | A63B 69/0002 |

* cited by examiner

ATHLETIC SWING TRAINING WEIGHT AND METHOD

CROSS-REFERENCE TO RELATED APPLICATIONS

This application claims the benefit of provisional patent application Ser. No. 62/006,047, filed on May 31, 2014 by a present inventor.

FIELD OF THE INVENTION

The present invention relates to a weighted training device and method for building the strength and control of a user training an athletic swing such as those used in baseball, softball, golf, tennis and the like. The present invention also relates to a device and method for teaching a user the proper execution of such a swing.

BACKGROUND OF THE INVENTION

A common method of athletic training or for preparing to execute a swing involves the use of a weighted element placed on the equipment to be used and executing the swing with increased weight. In particular baseball athletes often warm up for competition by swinging a bat with a heavy weighted element removably affixed to their bat, which is intended to loosen the athlete's muscles and improve performance during competition. A number of devices have been patented in the history of athletic training that provide a weighted element that meets this intent. Of such devices the following is a tabulation of some prior art that presently appears relevant:

| Pat. No. | Issue Date | Patentee |
|---|---|---|
| 3,521,883 | July 1970 | Hamilton |
| 3,623,724 | November 1971 | Lande |
| 3,971,559 | July 1976 | Diforte, Jr. |
| 5,050,877 | September 1991 | Wales |
| 5,980,397 | November 1999 | Hart et al. |
| U.S. Pat. No. 6,533,685 B1 | March 2003 | Otten et al. |
| U.S. Pat. No. 8,231,484 B1 | July 2012 | Quinn |

As intended such devices do offer added weight to the athletic equipment and afford the user a means of improved training and warming up for athletic competition, however the devices sited above offer no training feedback to the user. Further, such devices can become wedged onto the athletic equipment with such force as to make them difficult to remove when the training session is complete.

Another common method of athletic swing training involves the use of training devices intended to provide audible, visual or tactile feedback to the user pertaining to the proper timing of the execution of the swing being trained. Of this subset there is still an impressive quantity of patents pertaining to feedback provided by a moveable member propelled by the centrifugal acceleration of the swing along the axis of an elongated member striking a fixed implement attached to said member. Of such devices the following is a tabulation of some prior art that presently appears relevant:

| Pat. No. | Issue Date | Patentee |
|---|---|---|
| 3,136,546 | June 1964 | Connolly |
| 3,137,504 | June 1964 | Zordan et al. |
| 5,360,209 | November 1994 | Mollica |
| 5,577,966 | November 1996 | Duran |
| US 2002/0072041 A1 | June 2002 | Gallagher et al. |
| U.S. Pat. No. 6,949,036 B2 | September 2005 | Ciesar et al. |
| U.S. Pat. No. 8,187,124 B2 | May 2012 | Ciesar et al. |

The devices sited above offer training feedback pertaining to the proper execution of an athletic swing, however these devices require the athlete to use the device for training vs. allowing the user to use the athletic equipment that will be used during competition. As such, their utility is often limited and in certain cases restricted by the rules of the sport or activity the user is participating in.

Of the prior art the work of Vento in U.S. Pat. No. 5,024,436, 1991-Jun.-18 is also noteworthy. This patent provides a training device affixed to a baseball bat to be used in training exercise. This device provides feedback pertaining to the force of the user's swing, however does not provide feedback pertaining to the timing of the execution of the swing.

SUMMARY OF THE INVENTION

The present invention provides a swing training weight and method for the training of athletic swings providing a means of increasing the strength and control of the user, while teaching proper swing mechanics. The swing training weight includes a hollow elongated member that is temporarily attached to athletic equipment during training or while warming up for competition, and provides an improved means of release from the athletic equipment. Along the axis of the hollow elongated member is a movable stop and a sliding member. The movable stop provides the ability to vary the starting position of the sliding member, providing for a variety of training methods to be performed that allow for focused training of the proper execution of specific elements of an athletic swing.

When used, a sliding member is retained against a first stop at one end of the swing training weight. During the execution of the swing the centripetal acceleration generated by the swing causes the sliding member to travel down the weight striking a second stop at the opposite end of the swing training weight that simulates the impact of striking an object and provides audible, visual and tactile feedback to the user pertaining to the proper execution of the swing. This feedback may be further enhanced by the use of contrasting colors incorporated into its design.

Training methods using the swing training weight are provided that improve athletic performance, and allow for focused training of the proper execution of specific elements of an athletic swing. These training methods use the audible, visual and tactile feedback provided by the swing training weight to teach proper swing mechanics in addition to building strength and control. Further, the swing training weights provides a means of retaining the sliding member in the starting position allowing the swing training weight to be used to train a multitude of athletic swings, particularly those performed on a vertical plain such as golf swings.

DRAWING REFERENCE NUMERALS

1—Hollow Elongated Member,
Uniform External Cross Section
2—First Stop
3—Second Stop
4—Sliding Member
5—Hollow Elongated Member,
Substantially Uniform Internal Cross Section
6—Hollow Elongated Member,
Tapered Internal Cross Section
7—Release Member Recess
8—Release Member
9—Movable Stop
10—Bat
10*a*—Grip
10*b*—Tapered Portion
10*c*—Barrel Portion
11—User

DETAILED DESCRIPTION OF SPECIFIC EMBODIMENTS

First Embodiment—FIGS. 1, 2A, 2B, 3, 4

Figure 1:
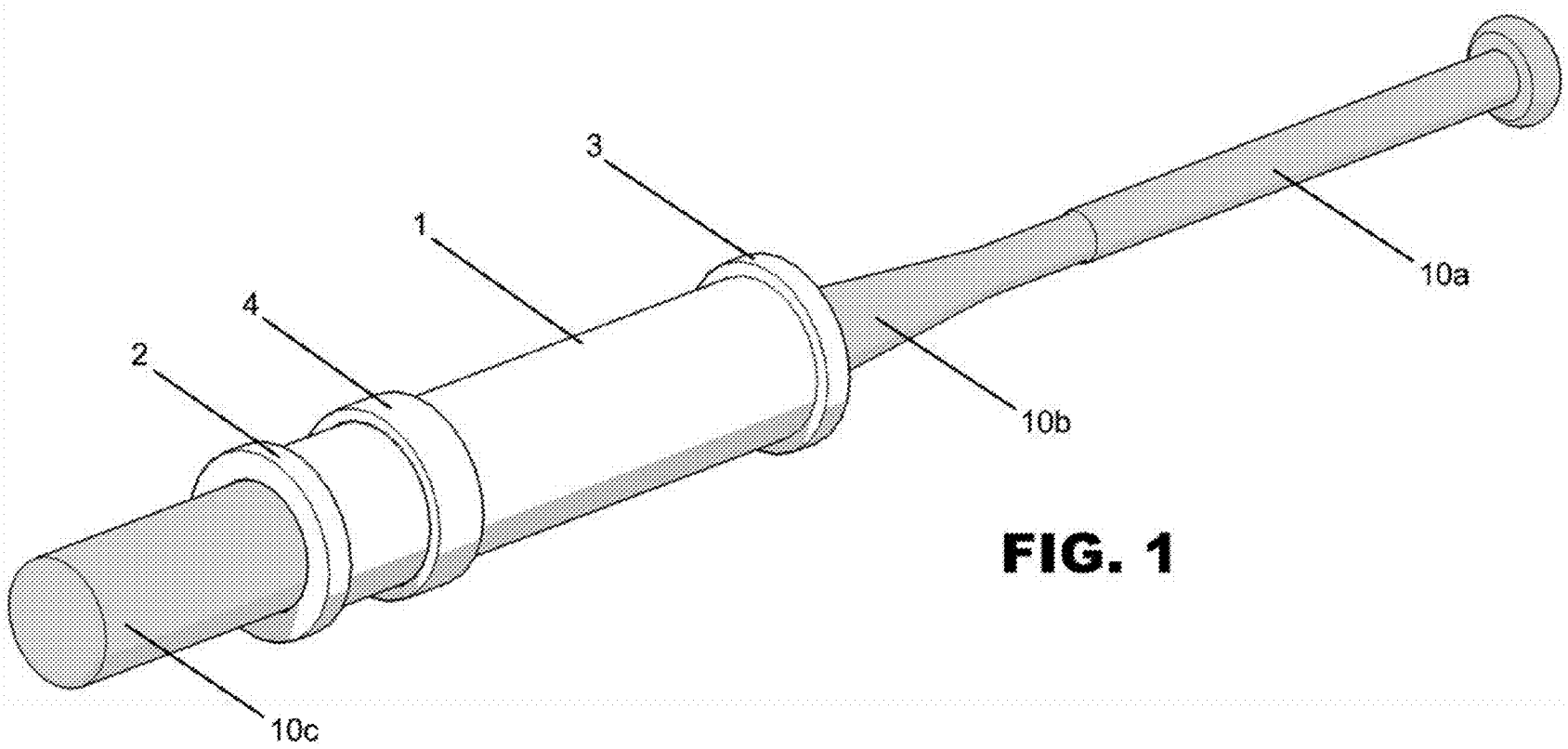
FIG. 1 is a perspective view of one embodiment of this invention on a bat.
Figure 2A:
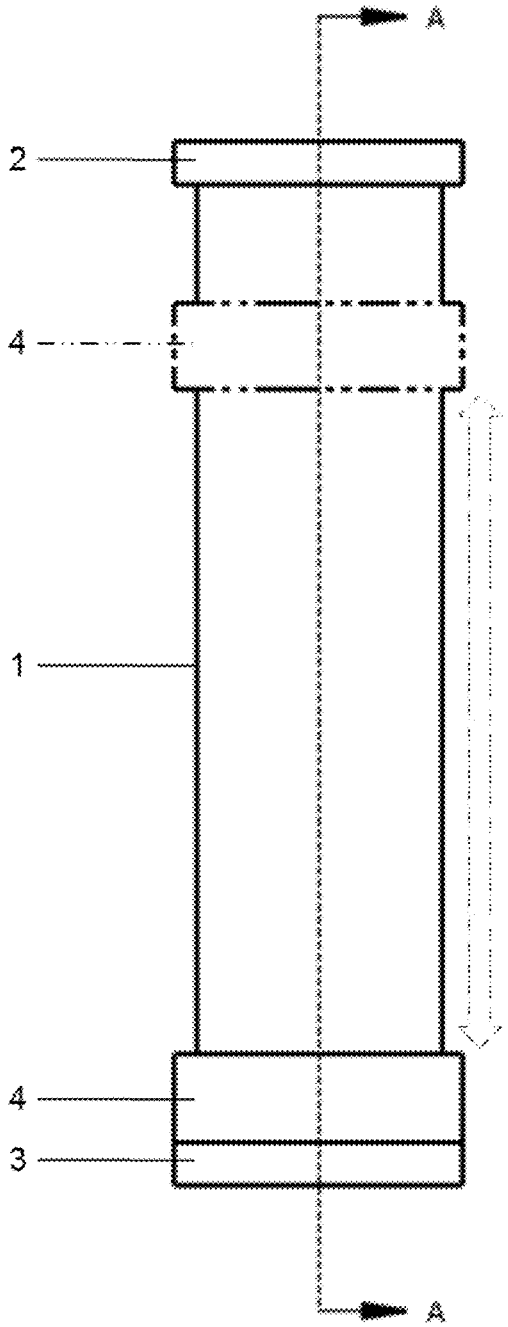
FIG. 2A is a front view of the embodiment of FIG. 1 with phantom lines illustrating the movement of a sliding member.
Figure 2B:
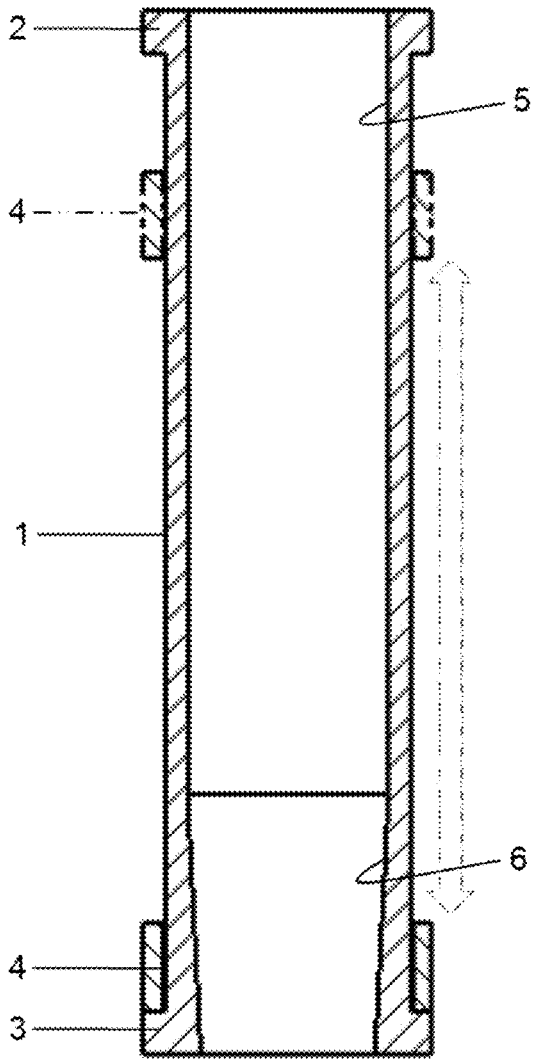
FIG. 2B is a cross-section view taken along lines A-A of FIG. 2A.

Referring to FIGS. 1, 2A and 2B, one embodiment of the swing training weight is shown. Specifically, these figures show a swing training weight comprising a hollow elongated member 1 with a substantially uniform internal cross section 5 at a first end sized to surround and extend over a barrel portion 10*c* of a bat. The hollow elongated member 1 having a tapered internal cross section 6 at a second end sized to wedge against a tapered portion 10*b* of the bat. The hollow elongated member 1 having a first stop 2 located at the first end, and a second stop 3 located at the second end. The hollow elongated member 1 having a uniform external cross section between a first stop 2 and second stop 3, and a sliding member 4 slidably mounted on the hollow elongated member 1 between the first stop 2 and second stop 3.

Figure 3:
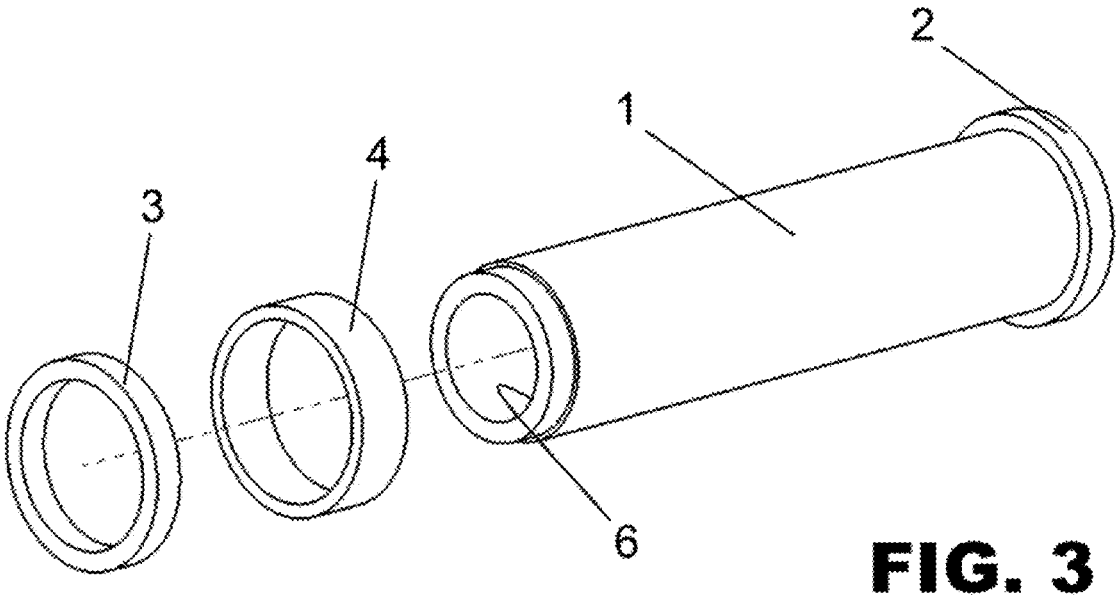
FIG. 3 is a perspective view of the embodiment of FIG. 1 showing a removable second stop.

The hollow elongated member 1 is the central structural member of the swing training weight, and is made of a sufficient mass as to accommodate the training needs of a user. I presently contemplate the hollow elongated member 1, first stop 2, second stop 3, first internal cross section 5, and second internal cross section 6, be made of a single molded part of rigid durable plastic, or be made as a plurality of independent members that are attached by threaded unions to provide a means to attach the sliding member 4 (FIG. 3). However, these members may be attached by welding, epoxy, glue or other suitable method, and may be independently made of varying materials such as rubber, polycarbonate, high carbon steel, titanium, etc., in order to provide the desired weight for the swing being trained, strength or abilities of the user.

Figure 4:
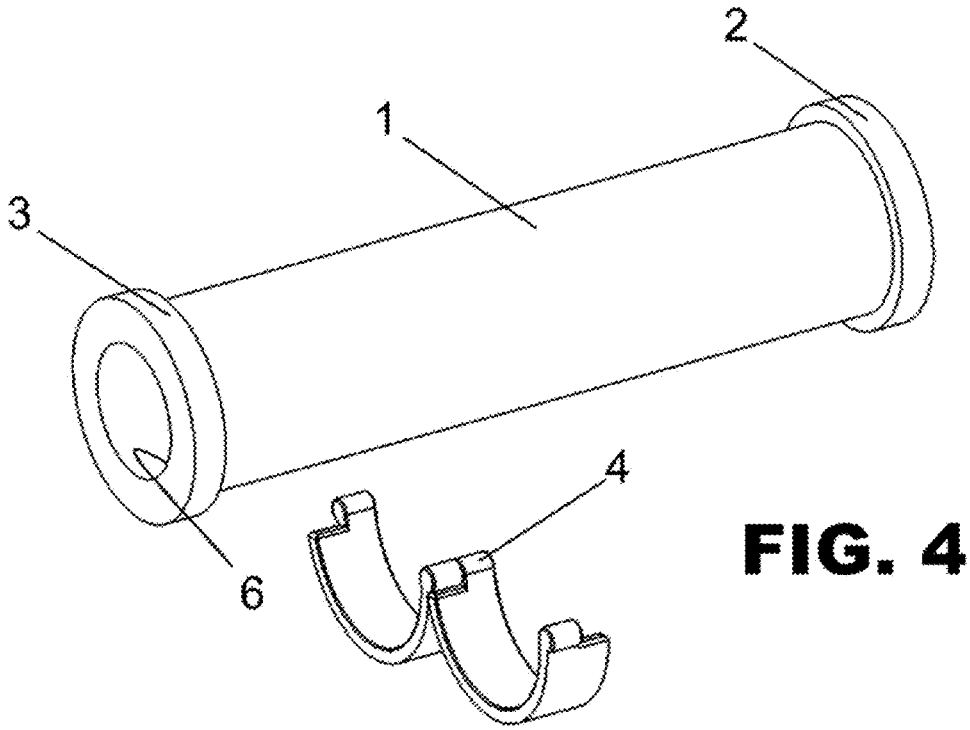
FIG. 4 is a perspective view of the embodiment of FIG. 1 showing a removable sliding member.

The sliding member 4 has an internal cross-section sufficient to allow it to be slidably attached to the hollow elongated member 1 and slides along the uniform external cross section between the first stop 2 and the second stop 3. The sliding member 4 may be made of varying geometries or materials in order to provide resistance to accommodate swing being trained, or strength or abilities of the user. I presently contemplate the sliding member 4 be made of a single molded part of rigid durable plastic, or be made of a plurality of parts releasably interconnected to provide a means to attach to the hollow elongated member 1 (FIG. 4). However, the sliding member 4 may be made of varying materials such as rubber, polycarbonate, high carbon steel, titanium, etc. The first stop 2, and second stop 3 are of sufficient external diameter as to retain the movement of the sliding member 4 along the uniform external cross section of the hollow elongated member 1. I presently contemplate that the second stop 3 and sliding member 4 be made of suitable materials, or contain suitable materials, such that the sliding member 4 is releasably retained against the second stop 3 at the starting position.

I presently contemplate that the first stop 2, second stop 3, and sliding member 4, be made of a high contrasting color providing for enhanced visual assessment of swing mechanics. The intent of the high contrast color is to be a color with great contrast to the uniform external cross section of the hollow elongated member, and thus easily identifiable by the user.

Operation of First Embodiment—FIGS. 1, 5A-5C

Figure 5C:
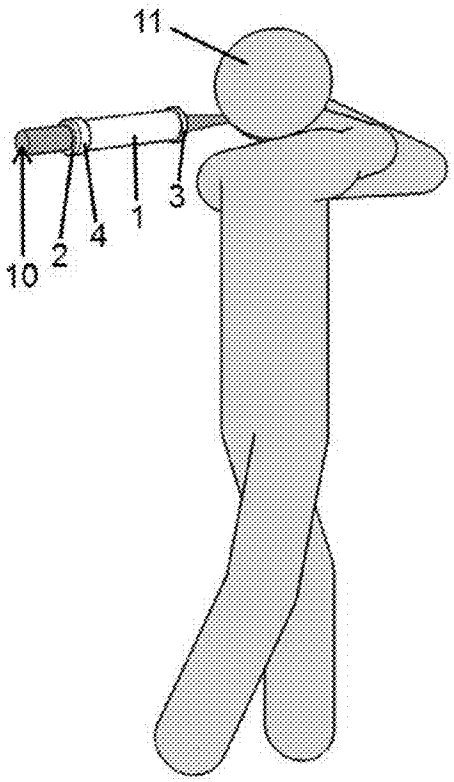
FIGS. 5A, 5B, 5C illustrate a first training method using the embodiment of FIG. 1.
Figure 5B:
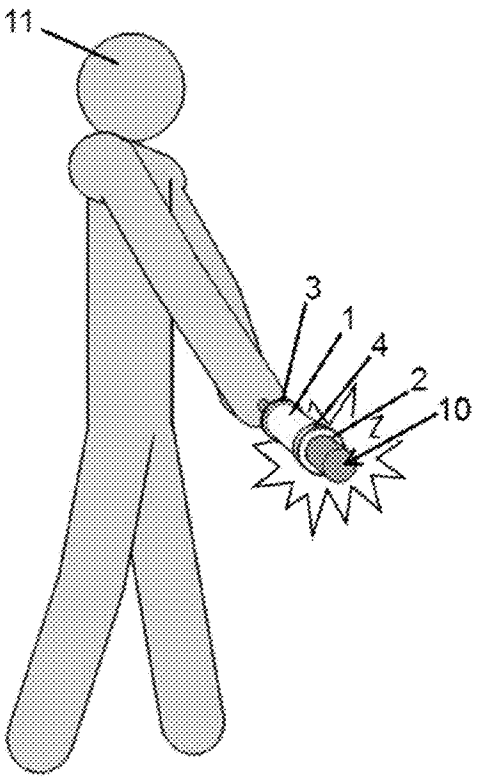
Figure 5A:
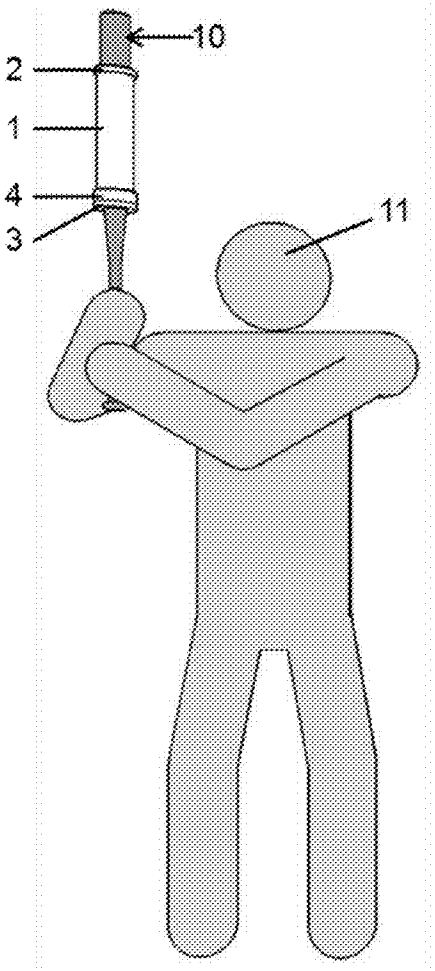

The swing training weight described above includes a sliding ember 4 that provides audible, tactile and visual feedback to user pertaining to the timing of the moment of full extension of the swing that simulates the sensation of striking an object. Referring to FIGS. 5A, 5B, and 5C, a first training method is described. This training method is intended to teach the proper engagement of the user's wrists when performing an athletic swing and provides additional weight to the user's equipment that provides for increased strength and bat control.

In this first method of using the swing training weight a user 11 slides the swing training weight onto a bat 10, by inserting the grip end of the bat 10*a* into the first end of the hollow elongated member 1 within the hollow portion located within the first stop 2. The swing training weight is removably secured onto the bat 10 by the wedging force of the tapered cross section 6 against the tapered portion of the bat 10*b*, in the orientation shown in FIG. 1.

In the starting position (FIG. 5A) the sliding member 4 rests against the second stop 3, and the bat is held by the user 11 with both hands at the grip 10*a*. The swing is then performed. The centrifugal acceleration generated by the user's swing propels the sliding member 4 along the hollow elongated member 1 until is strikes the first stop 2 producing an audible "cracking" sound and tactile feedback to the user, thus simulating the impact of striking an object (FIG. 5B). The timing of this impact (sound) provides immediate feedback to the user of the timing of the swing, which may be aided by the visual feedback provided high contrast colors used on the swing training weight. Optimal performance is achieved when the sliding member 4 strikes the first stop 2 as the user's wrists are extended at the ideal moment of the swing. The sliding member 4 maintains this position through the completion of the swing (FIG. 5C).

Upon completing the swing, the swing training weight is reset to the starting position by simply elevating the bat 10 as shown in FIG. 5A with the first end positioned above the second end, and the swing is again executed for a desired number of repetitions to warm up for athletic competition or to perform training to increase the strength of the user 11 while teaching proper swing mechanics. To remove the swing training weight the user grips the bat with the swing training weight attached at the barrel end above the swing training weight, or grips the swing training weight at the hollow elongated member 1. The user then tamps the grip end 10*a* of the bat against the ground one or more times until the swing training weight is released from the bat 10.

Figure 6:
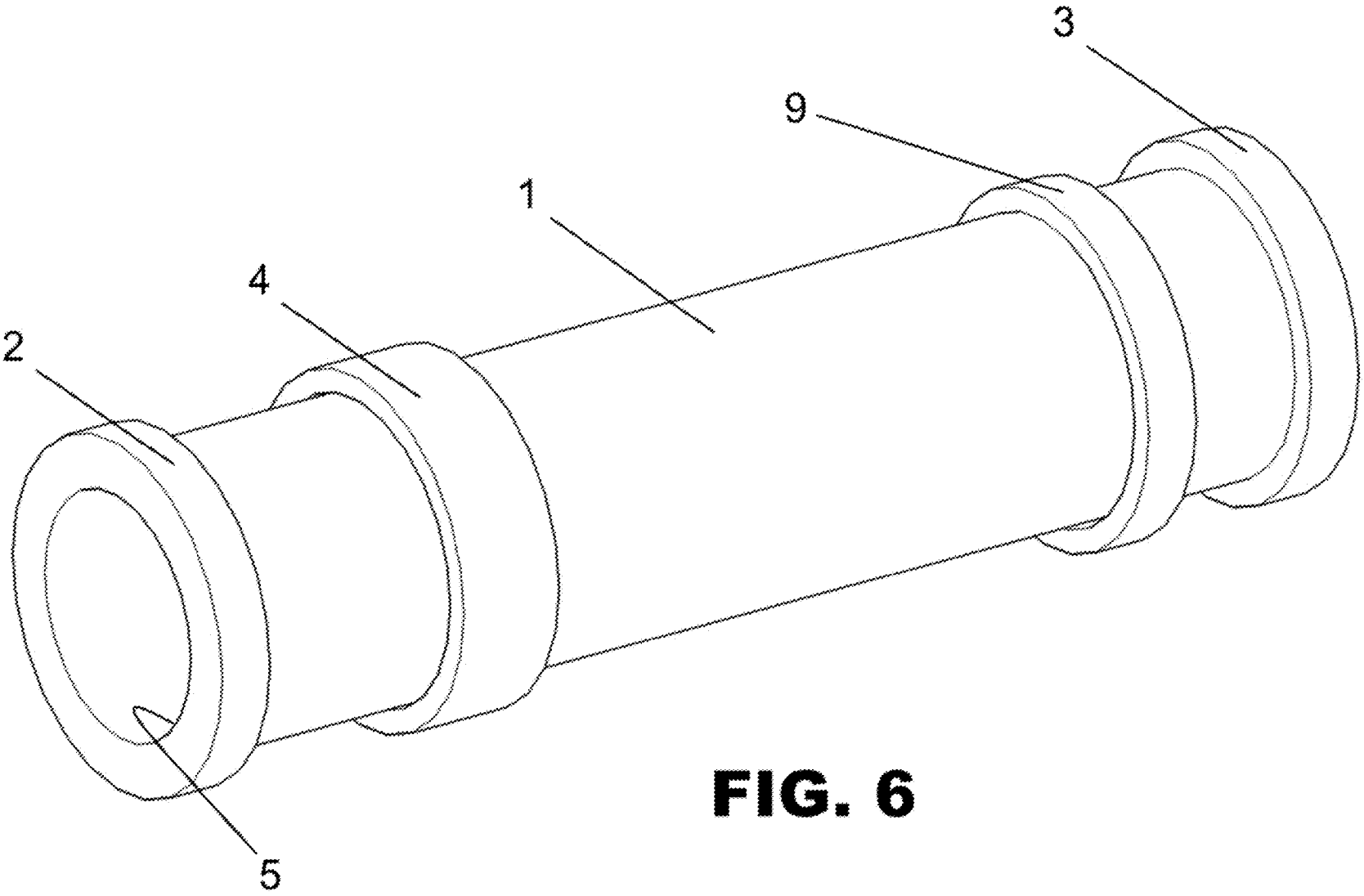
FIG. 6 is a perspective view of a second embodiment of this invention.

Second Embodiment—FIG. 6

Referring to FIG. 6, a second embodiment of the swing training weight is shown. This embodiment is the same as the first embodiment, with the addition of a movable stop 9 movably mounted on the hollow elongated member 1 between the second stop 3 and sliding member 4.

The movable stop 9 is movably attached to the uniform external cross section of the hollow elongated member 1, and is of sufficient diameter to retain the sliding member 4 allowing the user to move it along the hollow elongated member in order to vary the starting position the sliding member 4. This allows for the swing training weight to be configured for the training of multiple swing elements. I presently contemplate that the movable stop 9 to be made of a compliant material such that it is held in place against the hollow elongated member 1 by friction. However, the movable stop 9 can be made with a secondary element that actively applies a force against the hollow elongated member 1 to secure it in the desired starting position. The sliding member 4 is slidably attached to the hollow elongated member 1 and slides along the hollow elongated member between the movable stop 9 and first stop 2. I presently contemplate that the movable stop 9 and sliding member 4 be made of suitable materials, or contain suitable materials, such that the sliding member 4 is releasably retained against the movable stop 4 at the starting position.

Operation of Second Embodiment—FIGS. 7A, 7B, 8A, 8B

Figure 7A:
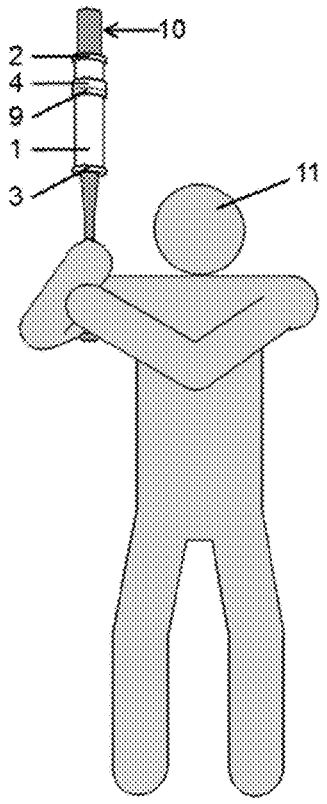
FIGS. 7A, 7B illustrate a second training method using the embodiment of FIG. 6.
Figure 7B:
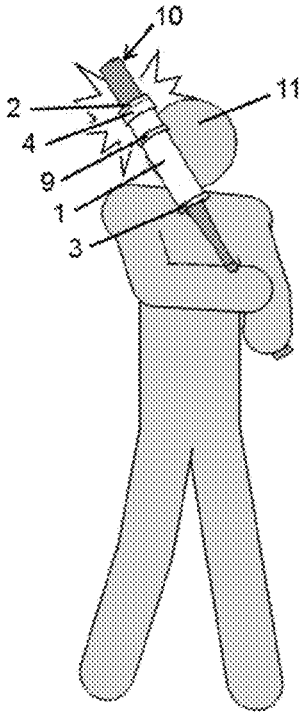

Referring to FIGS. 7A and 7B a second training method is described. In the proper execution of an athletic swing such as that used in baseball or golf the hands lead the bat or club through the swing. This training method is intended to teach the proper starting motion of the user's hands at the start of such a swing. In this method the swing training weight is held at the bat grip 10*a* by a user 11 with both hands with the movable stop 9 positioned along the hollow elongated member 1 near the first stop 2 providing for only a few inches of movement of the sliding member 4. The sliding member 4 rests against the movable stop 9 (FIG. 7A). The swing is then performed. With the movement of the sliding member 4 restricted to only a few inches the audible, tactile and visual feedback is provided upon the first motion of the swing training weight during the swing (FIG. 7B), thus the user is provided immediate feedback pertaining to the timing of the user's upper body (arms/hands) engaging in the swing. This feedback allows the user 11 to improve the coordination of the lower body and upper body in the swing as well as providing immediate feedback to correct any undesirable motion of the swing training weight during the swing, such as early extension of the wrists.

Figure 8A:
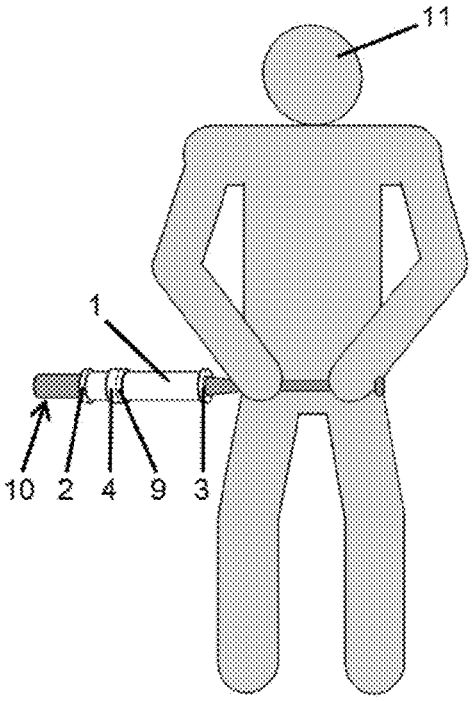
FIGS. 8A, 8B illustrate a third training method using the embodiment of FIG. 6.
Figure 8B:
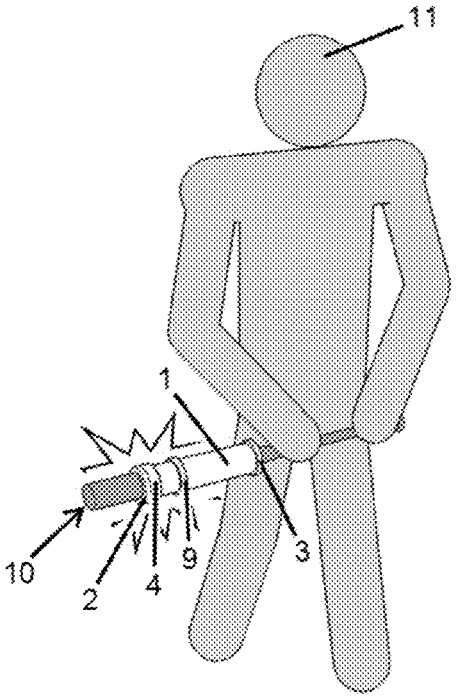

Referring to FIGS. 8A and 8B a third training method is described. In the teaching of a baseball or softball swing a common drill known as "squash the bug" is often instructed. In this drill the user is instructed to forcibly pivot their lower body as if squashing a bug, thus teaching the user the proper engagement of the lower body in an athletic hip turn. A common evolution of this drill requires the user to grasp a bat held against their waist or behind their back while executing the same motion. In this training method the same technique is employed, however the swing training weight aids this training by producing a satisfying "cracking" sound produced by the sliding member 4 striking the first stop 2 during the execution of this drill. In the starting positon the user holds the bat 10 with the swing training weight removably attached against their hips, or alternatively behind their back (not shown) with the movable stop 9 positioned along the hollow elongated member 1 near the first stop 2. The sliding member 4 rests against the movable stop 9 (FIG. 8A). The "squash the bug" motion is then executed, and the centrifugal acceleration of the turning of the user's hips propels the sliding member 4 along the hollow elongated member 1 until it strikes the first stop 2 producing and audible "cracking" sound (FIG. 8B). This feedback enhances the drill by providing a satisfying result, and aids in the ability to instruct the drill to the user.

Figure 9:
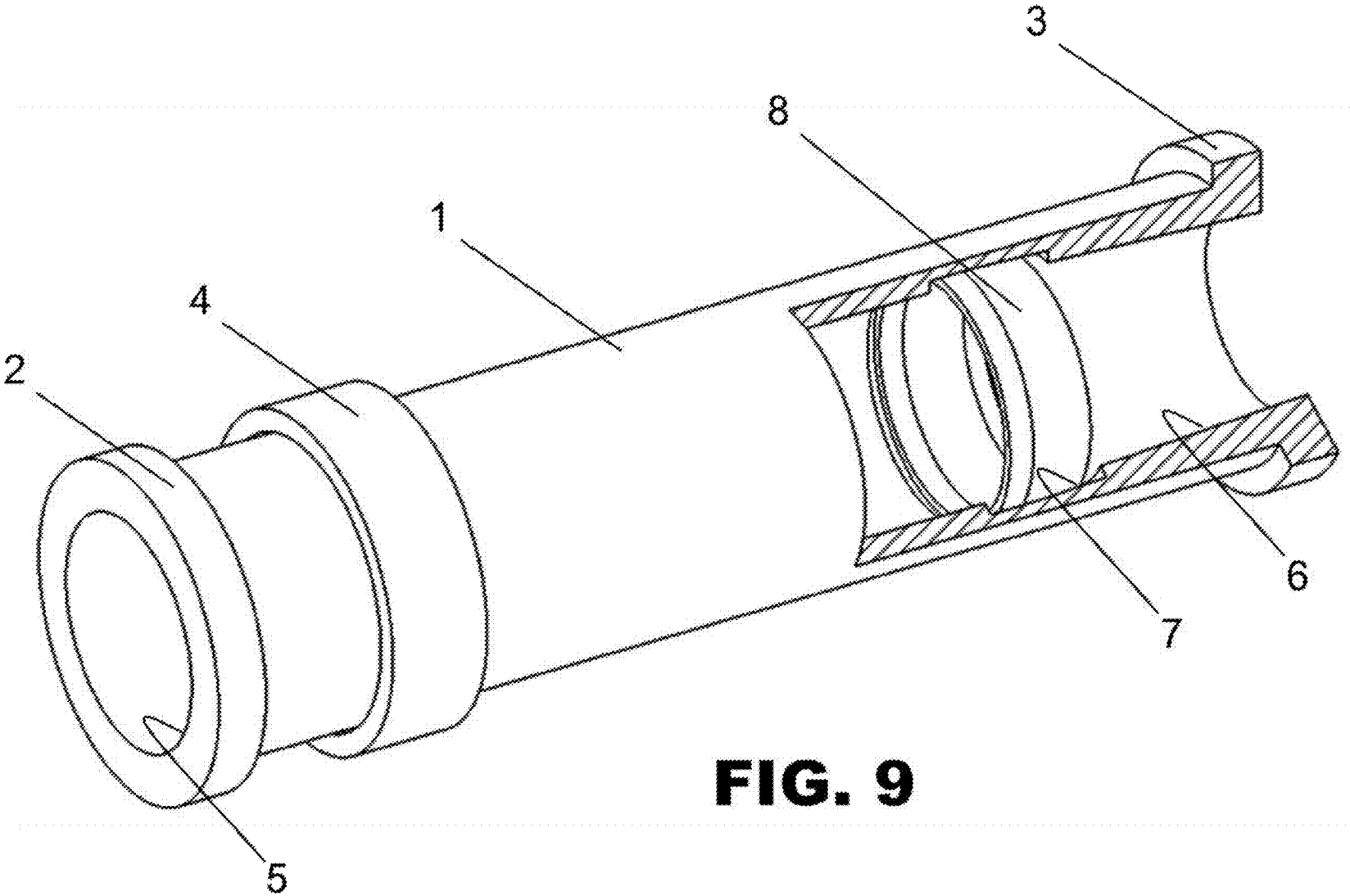
FIG. 9 is a perspective view of a third embodiment of this invention with a cut away to show internal components.

Description and Operation of Alternative Embodiment—FIG. 9

Referring to FIG. 9 a third embodiment of the swing training weight is shown. The swing training weight of this embodiment is similar to the first embodiment comprising a hollow elongated member 1, a first stop 2, a second stop 3, a sliding member 4 and a substantially uniform internal cross section 5 at the first end of the hollow elongated member. The present embodiment differs from the first embodiment in that contained within the tapered internal cross section 6 of the hollow elongated member 1, is a second tapered cross section defining a release member recess 7, that slidably retains a release member 8. The release member 8 having a tapered internal cross section to wedge against a tapered portion 10*b* of a bat, and a tapered external cross section to wedge against the release member recess 7 of the hollow elongated member 1, such that the release member 8 is sandwiched between the tapered potion 10*b* of the bat and the release member recess 7 when the swing training weight is used. The internal taper of the release member, external taper of the release member, and the taper of the release member recess are sized to produce a greater wedging force between the release member 8 and the tapered portion 10*b* of the bat, than the wedging force between the release member 8 and release member recess 7.

The description of this second embodiment is the same as the first embodiment with the exception of consideration to accommodate the release member recess 7, and release member 8. I presently contemplate the hollow elongated member 1, first stop 2, second stop 3, first internal cross section 5, second internal cross section 6, and release member recess 7, be made of a single molded part of rigid durable plastic, with the release member 8 being made of a suitable compliant material, such as rubber, that it can be deformed to be fit into the release member recess 7. However, the hollow elongated member 1 comprising; first stop 2, second stop 3, first internal cross section 5, second internal cross section 6, and release member recess 7, may be independent parts that are attached by threaded unions, welding, epoxy, glue or other suitable method, such that they allow for the inclusion of a release member 8 made of a rigid material that is not able to be deformed and inserted into the hollow elongated member. The components described above may be independently made of varying materials such as rubber, polycarbonate, high carbon steel, titanium, etc., in order to provide the desired weight for the swing being trained, strength or abilities of the user.

The force generated by the centripetal acceleration of a user's swing often results in the swing training weights being wedged onto the user's bat with sufficient force as to make them difficult to remove. As such, the present embodiment of this invention provides an improved means for removing the swing training weight from the user's equipment. To remove the swing training weight the user grips the bat with the swing training weight attached at the barrel end above the swing training weight, or grips the hollow elongated member 1. The user then tamps the grip end 10*a* of the bat against the ground causing the hollow elongated member 1 to move relative to the release member 8. This action allows for the momentum of the hollow elongated member 1 to apply an impulse force against the release member 8 at the release member recess 7, thus requiring a reduced force by the user to remove the swing training weight from the bat.

Advantages

From the description above, a number of advantages of some embodiments of my swing training weight become evident:

(a) When using a training weight on athletic equipment a user, particularly a novice user, often focuses on swinging the increased weight with little regard to the form and proper execution of the swing. Elite users of such training weights will often focus on proper swing mechanics, however the prior art warm up weights and apparatus provide no feedback to the user pertaining to the proper execution of the swing. The sliding member striking the first stop of at least one embodiment of the swing training weight described above provides audible, tactile and visual feedback to the user pertaining the proper execution of the swing. This visual feedback can be aided by the use of contrasting colors incorporated into the design. Thus, a novel training weight and training methods are provided, that allow the user to build strength and bat control while teaching proper swing mechanics. As such, the training utility of my swing training weight provides an advantage over prior art training weights.

(b) The movable stop of at least one embodiment described above provides for a plurality of training methods to be performed with the swing training weight. This novel feature of swing training weight provides utility over the prior art devices by allowing for training methods specifically designed to focus training on various elements of a swing.

(c) When using a training weight on athletic equipment the force generated by the centripetal acceleration of a user's swing often results in the swing training weights being wedged onto the user's equipment with sufficient force as to make them difficult to remove. The release member of at least one embodiment described above provides an improved means for removing the swing training weight from the user's equipment.

(d) Further, the second stop and movable stop described above provide a means of retaining the sliding member in the starting position. This design element allows the swing training weight to be used to train a multitude of athletic swings, particularly those performed on a vertical plain such as golf swings.

(e) Lastly the swing training weight described above is easily scalable to accommodate a broad range of athletic equipment and user abilities. Thus, an effective and low cost training weight can be provided for the training of athletic swings at all levels of athletics and related leisure activities.

Conclusion, Ramifications and Scope

Accordingly, the reader will see that the swing training weight of the various embodiments provides a swing training weight and training methods that aid a user in developing optimal athletic results by providing a training weight and training methods that build strength and bat control while teaching proper swing mechanics to a user, and at least one embodiment provides an improved means for removing the swing training weight from the user's equipment. The movable stop provides for a plurality of training methods to be performed with the swing training weight, and allows for training methods specifically designed to focus training on various elements of a swing. Additionally, the second stop and movable stop described above provide a means of retaining the sliding member in the starting position. This design element allows the swing training weight to be used to train a multitude of athletic swings, particularly those performed on a vertical plain such as golf swings.

Although the description above contains many specificities, these should not be construed as limiting the scope of the embodiments but as merely providing illustrations of some of several embodiments. For example, the swing training weight can be made of varying materials in order to provide a light weight swing training device; thus a device can be produced that affords the other training benefits of my swing training weight that does not significantly increase the weight of the athletic equipment being used. Further, one skilled in the art will recognize that the swing training weight can be made of varying form factors designed to wedge against a bat in such a way as not to extend over the barrel portion, or to similarly engage varying elements of similar athletic or leisure equipment, such as a golf club, cricket bat, tennis racket, etc. without departing from the objects of the invention. Similarly, the release member may be made to protrude from the second end of the swing training weight; thus allowing the swing training weight to be adapted to accommodate a greater range of athletic equipment. Additionally, the training methods of the embodiments are representative and illustrate the versatility of the feedback provided by my swing training weight, and are not intended to be inclusive of all training methods provided by the swing training weight. For example, training methods employing the use of only one hand of the user further provide for focused training on one or more elements of a swing.

Thus the scope of the embodiments should be determined by the appended claims and their legal equivalents, rather than by the examples given.

What is claimed:

1. A swing training weight, for use on a bat comprising a grip end, a tapered portion, and a barrel portion, the swing training weight comprising:

a. a hollow elongated member having a first and a second end;

b. a first stop located at said first end of said hollow elongated member;

c. a second stop located at said second end of said hollow elongated member;

d. said hollow elongated member having a uniform external cross section between said first stop and said second stop;

e. a sliding member slidably mounted on said hollow elongated member between said first stop and said second stop;

f. said hollow elongated member having a substantially uniform internal cross section at said first end that surrounds and extends over said barrel portion of said bat;

g. said hollow elongated member having a tapered internal cross section integrally connected to said substantially uniform internal cross section that narrows toward said second end, that surrounds and wedges against said tapered portion of said bat;

h. whereby said swing training weight is removably secured to said bat, and said sliding member slides along said hollow elongated member between said first stop and said second stop.

2. The swing training weight of claim 1 wherein the striking of said sliding member against said first stop provides audible, tactile and visual feedback.

3. The swing training weight of claim 2 wherein said first stop or said second stop are removable, whereby said sliding member is removable.

4. The swing training weight of claim 2 further comprising a removable sliding member.

5. The swing training weight of claim 1 wherein said tapered internal cross section provides a recess that slidably contains a release member between said hollow elongated member and said tapered portion of said bat, whereby the force required to remove said swing training weight from said bat is reduced.

6. The swing training weight of claim 5 wherein said release member is made of a compliant material such as rubber or silicone.

7. The swing training weight of claim 1 wherein said sliding member, said first stop, and said second stop are of a different color than said uniform external cross section of said hollow elongated member.

8. The swing training weight of claim 1 wherein said second stop retains said sliding member in a starting position, whereby said sliding member is maintained in said starting position when said swing training weight is held with said first end positioned below said second end.

9. The swing training weight of claim 8 further comprising a plurality of magnets or magnetic material incorporated in said second stop or said sliding member.

10. The swing training weight of claim 1 further comprising a movable stop mounted on said hollow elongated member providing a plurality of starting positions of said sliding member.

11. The swing training weight of claim 10 wherein said movable stop is located on said hollow elongated member between said second stop and said sliding member.

12. The swing training weight of claim 10 wherein said movable stop retains said sliding member in a starting position, whereby said sliding member is maintained in said starting position when said swing training weight is held with said first end positioned below said second end.

13. The swing training weight of claim 12 further comprising a plurality of magnets or magnetic material incorporated in said second stop or said sliding member.

14. The swing training weight of claim 1 wherein said first stop is a flange that extends the external cross section of said first end of said hollow elongated member sufficient to retain said sliding member, and said second stop is a flange that extends the external cross section of said second end of said hollow elongated member sufficient to retain said sliding member.

15. The swing training weight of claim 14 wherein said hollow elongated member has a substantially cylindrical cross section.

16. A method to build the strength and bat control of a user while teaching proper elements of an athletic swing, comprising:

a. said user using a bat comprising: a grip end, a tapered potion, and a barrel portion;

b. the user securing a training weight to said bat;

c. said training weight comprising: a hollow elongated member having a first and a second end, a first stop located at said first end of said hollow elongated member, a second stop located at said second end of said hollow elongated member, said hollow elongated member having a uniform external cross section between said first stop and said second stop, a sliding member slidably mounted on said hollow elongated member between said first stop and said second stop, said hollow elongated member having a substantially uniform internal cross section at said first end that surrounds and extends over said barrel portion of said bat, said hollow elongated member having a tapered internal cross section integrally connected to said substantially uniform internal cross section that narrows toward said second end, that surrounds and wedges against said tapered portion of said bat;

d. the user grasping said bat in the desired position for performing a desired training method;

e. the user performing said desired training method;

f. upon completing said desired training method the user uses the feedback provided by said swing training weight to assess the performance of said desired training method;

g. the user resetting said swing training weight to the desired starting position of said desired training method;

h. the user repeating said desired training method for a desired number of repetitions or until a desired result is achieved.

17. The method of claim 16 wherein said desired training method is intended to teach the proper engagement of said user's wrists when performing an athletic swing, whereby the force generated by said athletic swing is maximized, comprising:

a. the user grasping said bat at said grip while performing the athletic swing, causing said sliding member to travel along said hollow elongated member striking said first stop providing audible, tactile and visual feedback to said user;

b. the user observing the point during said athletic swing that said audible, tactile and visual feedback occurs, with optimal performance being achieved when said audible, tactile and visual feedback occurs as the users wrists are extended at the ideal moment of said athletic swing;

c. the user assessing the performance of said athletic swing based on the timing of said audible, tactile and visual feedback;

d. the user resetting said sliding member to the starting position by elevating said barrel portion of said bat such that said first end of the swing training weight is positioned above said second end and said sliding member rests against said second stop;

e. said user repeating said athletic swing for a desired number of repetitions or until the desired result is achieved.

18. The method of claim 16 wherein said desired training method is intended to teach the proper engagement of said user's lower body when executing an athletic hip turn, comprising:

a. the swing training weight of claim 16 further comprising a movable stop mounted on said hollow elongated member providing a plurality of starting positions of said sliding member;

b. the user configuring said swing training weight with said movable stop near said first end of said hollow elongated member;

c. the user holding said bat against their hips with both hands at approximately the grip;

d. the user performing an athletic hip turn, thus causing said sliding member to travel along said hollow elongated member striking said first stop providing audible, tactile and visual feedback to said user.

e. the user assessing the performance of said athletic hip turn based on the said audible, tactile and visual feedback;

f. the user resetting said sliding member to the starting position by elevating said barrel portion of said bat such that said first end of the swing training weight is positioned above said second end of the swing training weight and said sliding member rests against said removable stop;

g. the user repeating said athletic hip turn for a desired number of repetitions or until a desired result is achieved.

* * * * *